US006240983B1

(12) United States Patent
Beldham et al.

(10) Patent No.: US 6,240,983 B1
(45) Date of Patent: Jun. 5, 2001

(54) ANTI-FOAM SPLASH-PROOF VENTURI

(75) Inventors: Paul M. Beldham; Donald W. Smeller, both of Mission Viejo; Christopher W. Nesselroad, Dana Point, all of CA (US)

(73) Assignee: Knight, Inc., Lake Forest, CA (US)

( * ) Notice: Subject to any disclaimer, the term of this patent is extended or adjusted under 35 U.S.C. 154(b) by 0 days.

(21) Appl. No.: 09/538,324

(22) Filed: Mar. 30, 2000

(51) Int. Cl.[7] ..... B65B 1/04

(52) U.S. Cl. ..... 141/100; 141/105; 141/286; 141/67

(58) Field of Search ..... 141/9, 100, 105, 141/286, 67; 239/310, 318, 418, 419, 426, 433, 434, 434.5, 590, 602, 546, 533.13; 222/547, 564, 630, 494; 251/5; 366/163.2

(56) References Cited

U.S. PATENT DOCUMENTS 2,331,291 * 10/1943 Annin .
2,353,143 * 7/1944 Bryant .
2,360,873 * 10/1944 Grove .
2,622,620 * 12/1952 Annin .
3,624,801 * 11/1971 Gannon .
5,507,436 * 4/1996 Ruttenberg .
5,902,041 * 5/1999 Parsons et al. .

* cited by examiner

*Primary Examiner*—Gregory L. Huson
*Assistant Examiner*—Khoa D. Huynh
(74) *Attorney, Agent, or Firm*—Harry G. Weissenberger

(57) ABSTRACT

Foaming and lateral water leakage during the filling of a container with a foam-prone water/chemical mixture is minimized by using, at the inlet of the venturi nozzle which draws the chemical into the water, a water authority-approved resilient-sleeve air gap which furnishes air-free water to the venturi while providing a siphon-breaking air gap if water is not flowing into the venturi.

1 Claim, 2 Drawing Sheets

ANTI-FOAM SPLASH-PROOF VENTURI

FIELD OF THE INVENTION

This invention relates to a splash-proof anti-foam venturi device for mixing chemicals with water while filling containers with the mixture.

BACKGROUND OF THE INVENTION

In many situations, as for example in housekeeping activities for hotels, containers such as spray bottles need to be filled at frequent intervals with a cleaning solution or other mixture of water and liquid chemicals. Typically, such mixtures are obtained by passing a stream of water through a venturi which draws a liquid chemical from a concentrate source into the water stream that is discharged into the container.

If air is allowed to be entrained with the water/chemical stream discharged into the container, many cleaning solutions and other mixtures tend to foam quite strongly. As a result, foam overflows the container even if the container is nowhere near filled with liquid. Consequently, much time is wasted because either the container must be filled unnecessarily often, or the operator must fill the container very slowly.

Another related problem arises from the fact that the venturi devices require an air gap, i.e. a device which breaks any accidental siphon, so as to prevent water in the venturi from flowing back into the public water supply. In practice, the filling apparatus is typically mounted on a wall. Most conventional air gap devices of the type useful in such filling apparatus have a tendency, albeit small, to spit and splash spray water outwardly of the air gap device. This spray, and the resulting drip, is annoying and, over a period of time, tends to damage the wall and make the apparatus unsanitary.

Prior to the present invention, water public safety authorities would only approve for this purpose a completely open air gap device which would cause the above-described foaming, spitting and splashing. With the use of the present invention, applicants have been successful in obtaining local and national water authority approvals for anti-foaming splashproof venturis throughout the United States and many parts of the world.

SUMMARY OF THE INVENTION

The invention overcomes the above-mentioned problems of the prior art by combining a venturi with an air gap of the pipe interrupter type. That type of backflow preventer prevents water from exiting the air gap except through the venturi, and it also prevents air from being drawn into the water stream before it reaches the venturi. By thus keeping air out of the water/chemical stream exiting the venturi, foaming of the mixture as it is discharged into the container is greatly reduced.

DESCRIPTION OF THE PREFERRED EMBODIMENT

Figure 1:
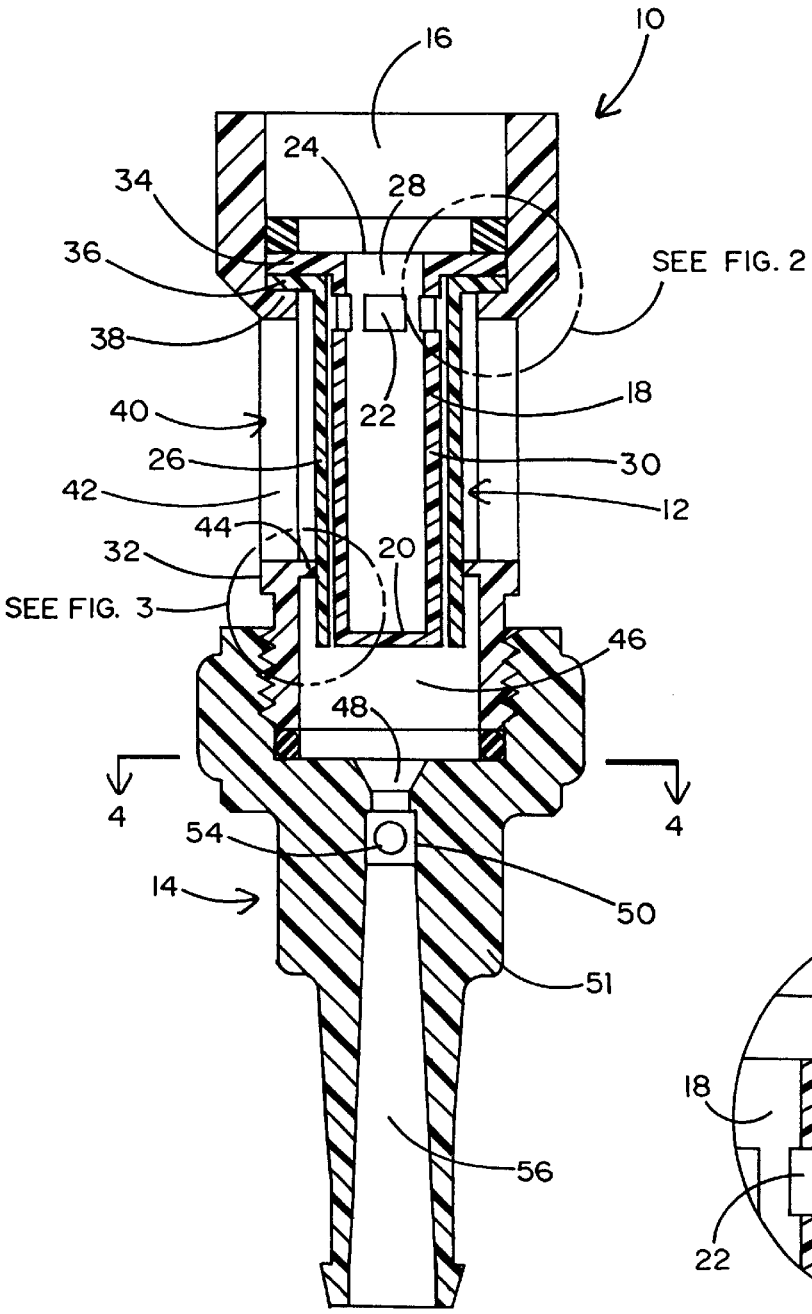
FIG. 1 is a vertical section through the venturi-and-airgap combination of this invention.
Figure 2:
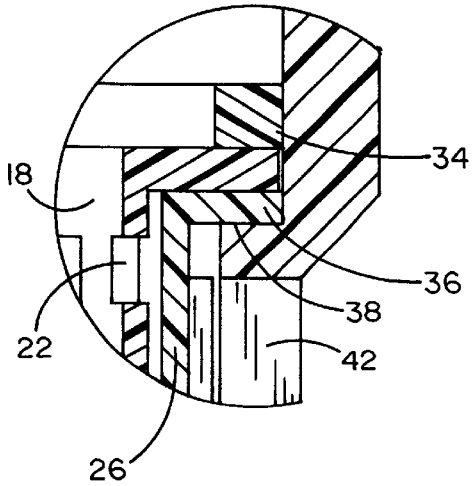
FIG. 2 is a detail section along line 2—2 of FIG. 1.

As will be seen from FIG. 1, the device 10 of this invention consists of an air gap section 12 and a venturi section 14. Water from the municipal water supply enters the air gap section 12 through an inlet plenum 16 and flows into the interior of a barrel 18 that is sealed at its bottom end 20 but has lateral openings 22 near its upper end 24. The barrel 18 is surrounded by a cylindrical elastic sleeve 26 whose inner diameter is a little larger than the outer diameter of the upper and intermediate portions 28, 30 of barrel 18, but smaller than the outer diameter of the bottom portion 32 of the barrel 18. The barrel 18 has an annular flange 34 at its top, and the sleeve 26 has a similar flange 36 at its top. When the air gap section 12 is assembled, the flange 36 is compressed between the flange 34 and the shoulder 38 at the top of the cage 40 (see FIG. 2). Air enters the cage 40 through the lateral slots 42, but water cannot spray outwardly through the slots 42 because the water is contained on the inside of the sleeve 26 throughout the length of the slots 42.

Below the air inlet slots 42, the air gap section 12 has an inwardly directed annular flange 44 which has an inner diameter slightly larger than the outer diameter of the sleeve at that point. This is the smallest outer diameter of the sleeve 26, because at that point it encircles the recessed portion 43 of the barrel 18 which is the smallest-diameter portion of the barrel 18.

Figure 3A:
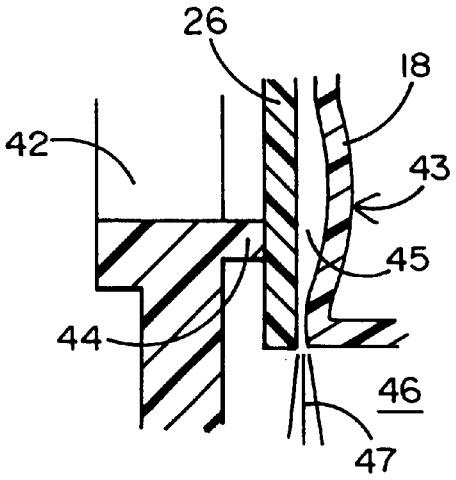
FIG. 3*a* is a detail section along line 3—3 of FIG. 1 when water is flowing.

When the water is turned on, it flows into the barrel 18 and fills it quickly. Additional water then exits through the lateral openings 22 in an essentially laminar flow into the space 45 between the barrel 18 and the sleeve 26. With water flowing into it, the sleeve 26 expands, and its outer surface eventually contacts the flange 44, sealing the plenum 46, and hence the venturi section 14, against the entry of any air from the slots 42 (FIG. 3*a*).

Figure 3B:
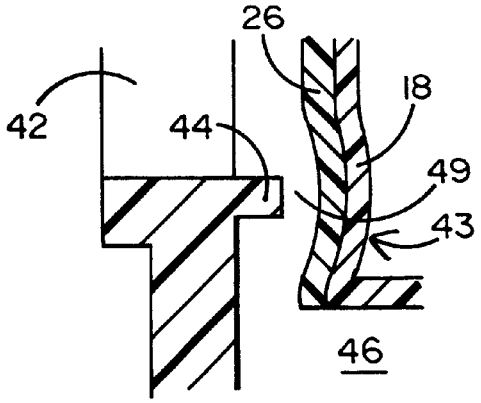
FIG. 3*b* is a detail section along line 3—3 of FIG. 1 when water is not flowing.

Thus, as long as water 47 flows toward the venturi section 14, that water is free of air. If a siphon action occurs in the municipal water line, the sleeve 26 is pulled tight against the outer surface of the barrel 18 (FIG. 3*b*). This seals off the barrel 18 and the water inlet, and at the same time opens the plenum 46 to the ambient air through the space 49 between the collapsed sleeve 26 and the flange 44.

Figure 4:
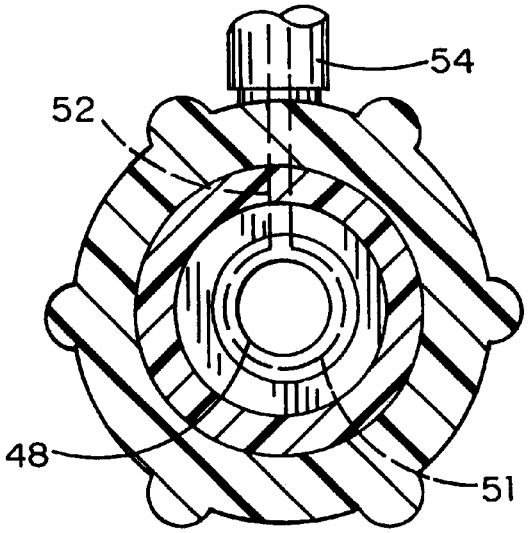
FIG. 4 is a horizontal section along line 4—4 of FIG. 1.

In the venturi section 14, the water flows from the plenum 46 into the throat 48 of the venturi 50. A passage 52, to which a cannula 54 (FIG. 4) coming from a source (not shown) of liquid chemical is connected, enters the venturi 50 at 51 just below its throat 48, where the sucking action of the venturi 50 draws the chemical into the water stream and mixes it with the water.

The water/chemical mixture exits the venturi 50 as a coherent, air-free stream which can fill a container such as a spray bottle (not shown) with a minimum of foaming. At the same time, no water can escape the inventive device other than through the venturi outlet 56, because as long as the water flows, the slots 22 are sealed off from the water stream.

It is understood that the exemplary anti-foam container filler described herein and shown in the drawings represents only a presently preferred embodiment of the invention. Indeed, various modifications and additions may be made to such embodiment without departing from the spirit and scope of the invention. Thus, other modifications and additions may be obvious to those skilled in the art and may be implemented to adapt the present invention for use in a variety of different applications.

We claim:

1. An anti-foam splash-proof nozzle for filling containers, comprising:

a) an air gap section;

b) a venturi section;

c) a plenum intermediate said venturi section, said plenum being in communication with ambient air in the absence of water flow;

d) said air gap section including:

i) a hollow barrel having a water inlet and lateral openings;

ii) an elastic sleeve surrounding said barrel and forming therewith a resiliently openable seal, said sleeve, when said seal is opened, defining a water path between said barrel and said sleeve into said plenum while at the same time sealing said plenum against ambient air; and e) said venturi section including:

i) a venturi;

ii) a water inlet from said plenum to said venturi;

iii) a passage for conveying a foam-prone chemical into the throat of said venturi to mix it with water flowing through said venturi; and iv) an outlet adapted to communicate with a container to be filled;

f) whereby said container can be filled with a minimum of foaming and no water leakage laterally of said nozzle.

* * * * *